United States Patent [19]

Isaacson

[11] 4,328,798

[45] May 11, 1982

[54] BREATHING APPARATUS WITH CONNECTOR SYSTEM FOR SUPPLYING EMERGENCY AIR TO ANOTHER INDIVIDUAL

[76] Inventor: Max Isaacson, 125 Sunrise Place, Dayton, Ohio 45407

[21] Appl. No.: 185,295

[22] Filed: Sep. 8, 1980

[51] Int. Cl.[3] ..... A62B 7/04

[52] U.S. Cl. ..... 128/202.27; 128/204.26; 128/205.24; 128/205.25

[58] Field of Search ..... 128/205.25, 205.27, 128/205.28, 205.29, 206.15, 200.14, 201.25, 201.28, 202.13, 202.26, 202.27, 202.28, 204.18, 204.21, 204.22, 204.23, 204.26, 204.27, 204.28, 205.12, 205.13, 205.17, 205.22, 205.24

[56] References Cited

U.S. PATENT DOCUMENTS

| | | | |
|---|---|---|---|
| 2,406,888 | 9/1946 | Meidenbauer, Jr. | 128/205.24 |
| 3,208,449 | 9/1965 | Bartlett, Jr. | 128/204.28 |
| 3,308,815 | 3/1967 | Wilcox et al. | 128/202.27 |
| 3,433,222 | 3/1969 | Pinto | 128/204.26 |
| 3,521,627 | 7/1970 | Murray | 128/202.27 |
| 3,575,167 | 4/1971 | Michielsen | 128/205.28 |
| 4,111,342 | 9/1978 | Kirby | 128/205.22 |

*Primary Examiner*—Henry J. Recla
*Attorney, Agent, or Firm*—Jacox & Meckstroth

[57] ABSTRACT

A fire-fighter carries a self-contained breathing apparatus wherein air is directed from a pressurized supply tank to a face mask through a pressure regulator and a demand inhalation valve connected to the face mask by a flexible breathing tube. A check valve and quick release coupler unit is connected to the pressure regulator and is adapted to be temporarily connected by an adaptor to the flexible breathing tube extending from the face mask of a breathing apparatus on a second fire-fighter to provide for quickly supplying emergency air to the second fire-fighter. Preferably, the adaptor is normally retained and carried in an inactive position by the coupler unit so that it is always available for immediate use.

4 Claims, 3 Drawing Figures

BREATHING APPARATUS WITH CONNECTOR SYSTEM FOR SUPPLYING EMERGENCY AIR TO ANOTHER INDIVIDUAL

BACKGROUND OF THE INVENTION

When it is necessary for a rescue person such as a fire-fighter to work in an environment or atmosphere containing a toxic gas, he usually wears a self-contained breathing apparatus or system. The system usually incorporates a pressurized air supply tank which is carried on the back of the fire-fighter. A flexible air line extends from the tank to a pressure regulator which supplies air at a preselected pressure to a demand inhalation valve, and the inhalation valve has an outlet connected by a flexible breather tube to a face mask worn by the fire-fighter. The inhalation valve is responsive to the air demand within the face mask and is referably constructed to minimize the breathing effort of the fire-fighter.

Occasionally, it is necessary for one fire-fighter using a breathing system to supply emergency air to another fire-fighter who is in distress, for example, by inadvertently depleting his air supply tank or by being trapped within the toxic environment. If the rescue fire-fighter carries with him a transparent plastic hood and an air supply tube, the tube may be used to connect the hood temporarily to the breathing apparatus of the rescue fire-fighter for supplying emergency air to the hood which is placed over the head of the distressed fire-fighter. However, most fire-fighters do not wish to carry with them an emergency air supply hood and another air supply line for the hood.

SUMMARY OF THE INVENTION

The present invention is directed to an improved breathing system or apparatus which is adapted to be worn by a fire-fighter or other rescue person and which enables one fire-fighter who is wearing the breathing apparatus to supply emergency air quickly to a distressed fire-fighter who is wearing the same breathing apparatus but has exhausted the compressed air within his supply tank. In general, this important feature provided by the breathing apparatus of the invention, is accomplished by providing the breathing apparatus with a combined quick release check valve and coupler unit which is connected to the pressure regulator of the breathing apparatus. A tubular adapter has one end portion constructed to be inserted into the coupler for opening the check valve, and the adapter also includes means for receiving a disconnected end of the air breather tube which extends from the face mask forming part of a breathing apparatus on another individual. As a result, the rescue fire-fighter may quickly disconnect the breathing tube connected to the face mask on a distressed fire-fighter and then quickly connect the breathing tube to the breathing apparatus carried by the rescue fire-fighter, thereby providing the distressed fire-fighter with emergency air and enabling him to be removed from the toxic atmosphere.

Other features and advantages of the invention will be apparent from the following description, the accompanying drawing and the appended claims.

DESCRIPTION OF THE PREFERRED EMBODIMENT

Figure 1:
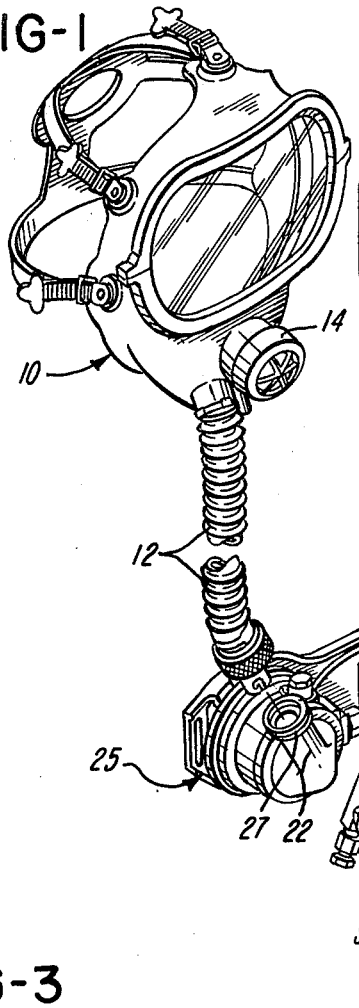
FIG. 1 is a perspective view of a breathing apparatus constructed in accordance with the invention and with certain components disconnected.
Figure 2:
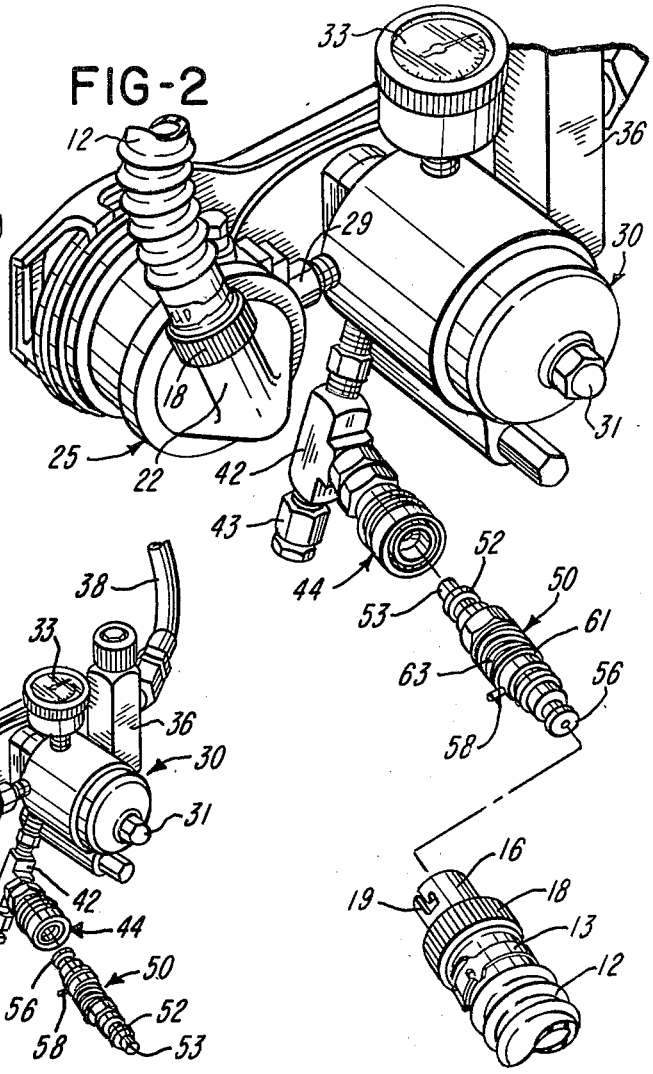
FIG. 2 is an enlarged perspective view of a portion of the breathing apparatus shown in FIG. 1 and illustrating the adapter in a position for coupling the breathing apparatus to the face mask breathing tube of another breathing apparatus.
Figure 3:
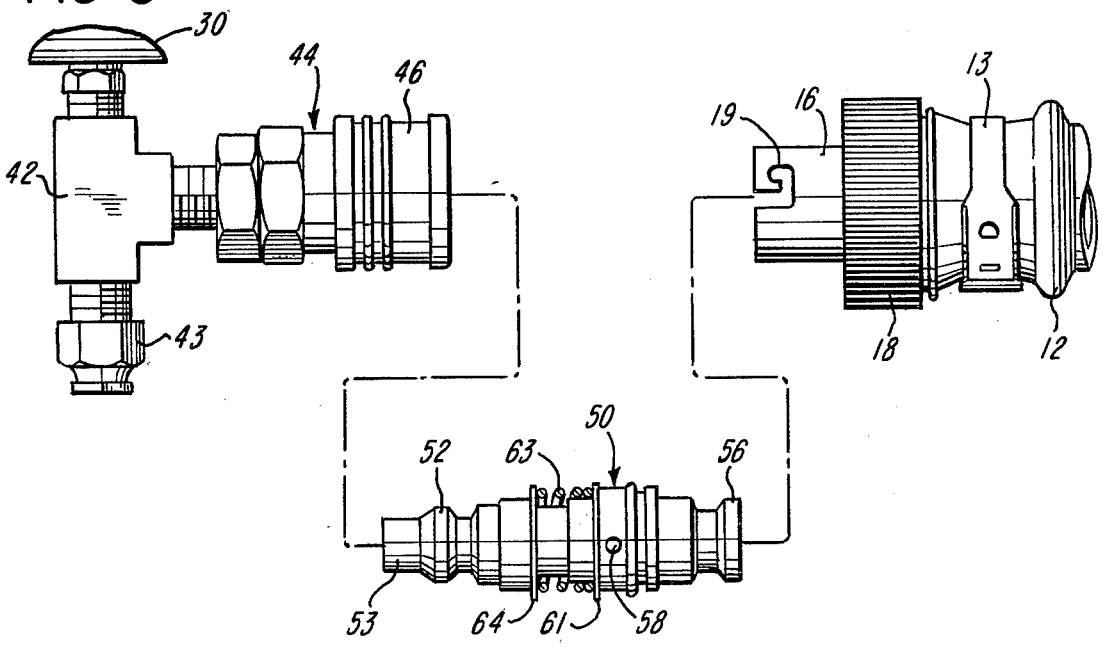
FIG. 3 is an enlarged exploded elevational view showing the adapter for coupling the breathing apparatus shown in FIGS. 1 and 2 to the breathing tube of another breathing apparatus which is identical to the apparatus shown in FIGS. 1 and 2.

The breathing system or apparatus illustrated in FIG. 1 includes a face mask 10 which is adapted to be worn by a fire-fighter or fireman and is supplied with air through a flexible breathing tube 12. The air exhaled by the individual is exhausted through an exhaust check valve 14. The breathing tube 12 is connected by a hose clamp 13 to a coupling tube 16 which supports a rotatable fitting 18 (FIG. 3) having internal threads. The cylindrical coupling tube 16 has a bayonet-type slot 19. The coupling tube 16 telescopes within an outlet portion 22 of a demand inhalation valve 25, for example, of the type constructed as disclosed in applicant's patent application Ser. No. 145,617 filed May 1, 1980. The outlet portion 22 has external threads 27 for receiving the internally threaded rotary coupling sleeve 16 on the breather tube 12. The demand inhalation valve 25 has an air inlet portion 29 which is connected to the outlet of a pressure regulator 30 adapted to be adjusted by rotating an outwardly projecting fitting 31. A pressure gauge 33 is connected to the pressure regulator 30 and displays the pressure of the air received by the pressure regulator through a main controlled valve 36 and a flexible air supply line 38 extending from a supply tank (not shown) of compressed air.

An L-shaped fitting 42 is connected to the pressure regulator 30 for receiving air at the same low pressure as supplied to the demand inhalation valve 25, and the fitting supports a pressure relief valve 43. A combined check valve and quick release coupler 44 is connected to the fitting 42 and includes a spring bias axially movable locking sleeve 46. The internal construction of the coupler 44 is well known, and the internal check valve within the coupler is normally closed.

In accordance with the invention, a tubular adaptor 50 includes an end portion 52 which is adapted to be inserted into the coupler 44 after the locking sleeve 46 is retracted, and the cylindrical tip portion 53 of the adaptor is effective to open the check valve within the coupler 44. The adapter 50 also has a second end portion 56 which is similar in external configuration to the end portion 52, but without the cylindrical tip portion 53. A pin 58 projects radially outwardly from the end portion 56 of the tubular adapter 50, and the end portion 56 is adapted to slide or telescope within the coupling tube 16 projecting from the rotary coupling sleeve 18 on the lower end of the breathing tube 12. When the adaptor end portion 56 is inserted into the coupling tube 16 with the pin 58 aligned with the bayonet slot 19, the end surface of the coupling tube 16 engages an axially movable washer 61 which is biased against an external shoulder on the adaptor 50 by a compression spring 63 surrounding the center portion of the adaptor 50. The opposite end of the spring 63 engages a washer 64 which seats against another external shoulder on the adapter 50. The adapter 50 is constructed and assembled with the spring 63 and washers 61 and 64 by forming the end portions 52 and 56 as separate pieces and then connecting the end portions by a threaded section (not shown).

As shown in FIG. 1, the adaptor 50 is normally carried by the breathing apparatus shown in FIG. 1 with the end portion 56 of the adaptor inserted into the coupler 44. In this position, the adaptor 50 is retained by the coupler, but the adaptor is not effective to open the check valve within the coupler since this end portion of the adaptor 50 does not have the projecting tip portion 53 which is effective to open the valve within the coupler 44. Thus the coupler 44 functions to carry the adaptor 50 so that the adaptor 50 remains at all times with the breathing apparatus shown in FIG. 1. In the event that it is necessary for the person or individual wearing the breathing apparatus shown in FIG. 1 to supply emergency air to a distressed person or individual wearing a similar breathing apparatus, but having a depleted air supply tank, the adaptor 50 is released from the coupler 44. The coupling sleeve 18 is unthreaded from the demand inhalation valve 25 of the breathing apparatus on the distressed individual, and the coupling tube 16 on the breathing tube 12 extending from the face mask on the distressed individual is quickly coupled to the end portion 56 of the adaptor 50. The adaptor 50 is retained within the tube 16 by the pin 58 within the bayonet slot 19. The end portion 52 of the adaptor 50 is then inserted into the coupler 44 so that the tip portion 53 opens the check valve within the coupler 44. Pressurized air is then supplied from the pressure regulator 30 of the breathing apparatus on the rescue individual to the face mask on the distressed individual.

From the drawing and the above description, it is apparent that a breathing apparatus or system constructed in accordance with the present invention, provides desirable features and advantages. For example, by the simple use of an adaptor, a fire-fighter wearing a breathing apparatus in accordance with the invention may quickly provide emergency air to another fire-fighter who is also wearing the breathing apparatus of the invention, but who has lost his air supply. As a result, the breathing apparatus of the invention significantly reduces the time required to supply emergency air to another fire-fighter in distress and thereby improves the chance of saving the life of the person in distress. As mentioned above, the adaptor 50 is also normally carried by the breathing apparatus with the end portion 56 being retained by the coupler 44 during normal use of the breathing apparatus. In such a retained position, the outwardly projecting end portion 52 including the tip portion 53 of the adaptor 50 may be protected by a disposable sanitary plastic dust cap. While the person using the breathing apparatus may wish to carry the adaptor 50 in his pocket, it is preferred that the adaptor 50 be normally carried by the coupler 44 so that the adaptor is always available to be quickly reversed and coupled to the breathing tube extending from the face mask on a distressed individual.

While the form of breathing apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Breathing apparatus adapted to be carried by a fire-fighter or other rescue individual, comprising a face mask, a pressure regulator adapted to receive pressurized air from a supply tank, conduit means connecting said facemask to said pressure regulator, a demand inhalation valve in said conduit means receiving air from said pressure regulator and responsive to the breathing demands of the individual, a quick release coupler including inlet means having a normally closed check valve therein and connected to receive air from said pressure regulator, a separate tubular adaptor having one end portion including means releasably coupled into said inlet means of said coupler, said one end portion having means effective to open said check valve when coupled to said coupler, said adaptor having a second end portion including means for releasably receiving a breathing tube extending from a face mask of a second individual in distress for supplying emergency air to the second individual, and said second end portion of said adaptor having means adapted to be releasably coupled into said inlet means of said coupler without opening said check valve to retain said adaptor with said coupler when not in use.

2. Apparatus as defined in claim 1 wherein said means for releasably receiving a breathing tube extending from a face mask of a second individual, comprise a connector having one end adapted to be connected to a breathing tube extending from a facemask of a second individual and an opposite end connected to the second end portion of said adaptor by a bayonet-type connection.

3. Apparatus as defined in claim 2 wherein said adaptor includes means for biasing said bayonet-type connection in a direction for retaining said connector to said adaptor.

4. Breathing apparatus adapted to be carried by a fire-fighter or other rescue individual, comprising a face mask, a pressure regulator adapted to receive pressurized air from a supply tank, conduit means connecting said facemask to said pressure regulator, a demand inhalation valve in said conduit means receiving air from said pressure regulator and responsive to the breathing demands of the individual, quick release coupler including inlet means having a normally closed check valve therein and connected to receive air from said pressure regulator, a separate tubular adaptor having an actuating end portion including means releasably coupled into said inlet means of said coupler, said actuating end portion having means for opening said check valve in response to connecting said actuating end portion into said inlet means of said coupler, said adaptor further having an opposite coupling end portion including means for releasably receiving a breathing tube extending from the face mask of a second individual in distress for supplying emergency air to the second individual, and said adaptor including means for coupling said adaptor into said inlet means of said coupler without opening said check valve to retain said adaptor with said coupler when not in use.

* * * * *